United States Patent [19]

Grossman

[11] 4,396,026

[45] Aug. 2, 1983

[54] CIGARETTE AND FILTER FOR TOBACCO SMOKE

[75] Inventor: Harold Grossman, Silver Spring, Md.

[73] Assignee: Montclair Research Corporation, Silver Spring, Md.

[21] Appl. No.: 209,277

[22] Filed: Nov. 21, 1980

Related U.S. Application Data

[60] Continuation of Ser. No. 893,990, Apr. 6, 1978, abandoned, which is a continuation-in-part of Ser. No. 707,072, Jul. 20, 1976, abandoned, which is a division of Ser. No. 479,103, Jun. 13, 1974, abandoned.

[51] Int. Cl.[3] ..... A24D 3/26

[52] U.S. Cl. ..... 131/333; 131/342; 131/343; 131/362

[58] Field of Search ..... 131/331, 332, 333, 334, 131/341, 342, 343, 344, 345, 200, 362

[56] References Cited

U.S. PATENT DOCUMENTS 2,181,614 11/1939 Striefling ..... 131/331

3,313,305 4/1967 Noznick et al. ..... 131/331

3,878,854 4/1975 Albein et al. ..... 131/331

FOREIGN PATENT DOCUMENTS 173263 12/1952 Austria ..... 131/200

*Primary Examiner*—V. Millin

*Attorney, Agent, or Firm*—Shapiro and Shapiro

[57] ABSTRACT

A filter for tobacco smoke comprises a porous substrate which has a deposit thereon of particles which are crystalline, positively charged at the pH of tobacco smoke, water-insoluble, hydrophobic, and oleophilic to provide a coalescing agent which acts to attract and neutralize the negatively charged particles which are dispersed in tobacco smoke. To increase the effectiveness of the filter, the tobacco has mixed therewith and deposited thereon particles of a water-insoluble, hydrophobic, moisture-laden, negative charge-imparting substance. Cigarettes made with tobacco thus treated furnish a number of advantages without being associated with the filter of the invention.

14 Claims, No Drawings

CIGARETTE AND FILTER FOR TOBACCO SMOKE

This is a continuation application of Ser. No. 893,990, filed Apr. 6, 1978 now abandoned, which is a continuation-in-part application of Ser. No. 707,072, filed July 20, 1976 now abandoned, which in turn is a division of application Ser. No. 479,103, filed June 13, 1974 now abandoned.

The invention relates to improvements in filters for tobacco smoke, and to the combination of a body of divided tobacco which is treated to make the filter associated with the tobacco more effective.

BACKGROUND OF THE INVENTION

Cigarette filters now in commercial use are only partially effective; they remove approximately 30% of the tars and nicotine. The approximately 70% that passes the filter obviously is not trapped by the filter material. The reason is that these substances are in the form of fine particles which are colloidally dispersed, and because of their small size pass through the usual or known filters with the gases in which they are dispersed.

Tobacco smoke is a two-phase system: a vapor phase and a dispersed particulate phase. The vapor phase may be considered the fraction which is volatile about 86° F., which is smoking temperature, and some high boiling point components not immediately condensed. The smoke consists of approximately 4–9% particulate matter of particles dispersed in the 91–96% vapor phase components. The vapor phase components consist of nitrogen, oxygen, carbon monoxide gases and other materials which are in the gaseous state about 86° F. During the smoking process, pyrosynthesis, pyrolysis, and distillation take place, and it has been estimated that there are as many as 700–800 resulting compounds. Straight chain hydrocarbons predominate.

When a cigarette is being smoked, the particulates which are generated have Brownian movement within the gaseous vapor phase. Observations with a dark field condenser, dialysis, electrophoresis, and Tyndal studies indicate that many particulates in the smoke are negatively charged and have lively Brownian motion. It has been estimated that there are approximately $2\times10^9$ negatively charged particles per millimeter in tobacco smoke.

Also, one of the serious problems in the filtration of tobacco smoke is the hydrophobic character of the carcinogenic tars, which are oleophilic. A wet filter will not hold on its surface the particulates having a hydrophobic character.

In Striefling U.S. Pat. No. 2,181,614; Nov. 28, 1939, a cigarette filter is disclosed which comprises a porous substrate impregnated with an oxide or hydroxide of calcium, magnesium, aluminum or silicon, including aluminum oxide in colloidal form. The colloidal alumina, however, is made by a wet process as distinguished from the dry process and is in amorphous form. Also, the impregnated filter medium is definitely alkaline. Reliance is placed upon the porous or highly absorptive structure of the described filter medium for the mechanical absorption and chemical neutralization of the nicotine vapors and acid fumes.

SUMMARY OF THE INVENTION

In accordance with the invention, a filter for tobacco smoke is provided which acts to attract the negatively charged particles dispersed in tobacco smoke. A suitable porous substrate has deposited thereon particles of a substance which is crystalline, positively charged at the pH of tobacco smoke, water-insoluble, hydrophobic, and oleophilic which acts to attract and neutralize the negatively charged particles dispersed in the tobacco smoke so that the filter will hold on to the neutralized particles and prevent such particles from passing with the gases through the filter to the smoker's mouth.

Based upon tests and observations of filters made in accordance with the invention, the deposit on the porous substrate of particles having the aforementioned properties or characteristics acts as a coalescing agent upon the colloidally dispersed negative particles in the smoke to enlarge them and render them more easily filterable. By coalescing the particles to shift the size distribution to the larger portion of the size-distribution curve, much more effective filtration is accomplished. As the size of the coalesced particles increases, the mass becomes larger thereby decreasing the number of particles in the smoke. Increasing the mass, increases the probability of the particles contacting the adsorber surface of the filter. As the diameter of the coalesced mass of particles increases, the distance from the particle to the absorbing surface becomes shorter. The universal gravitational attraction increases; also, the electrostatic forces between the larger coalesced particles and the absorber are increased. Since removal of particulates in smoke depends on probability of collision or contact with the adsorber surface, the probabilities are increased with increased particle size. This is essentially a physical phenomenon. The velocity of flow of the larger particles is slower than that of the smaller particles. Increased mass decreases the velocity of the particles in the gas flow. The larger the mass, the greater the initial impaction which is a major influence in filter efficiency. Thus, by causing the colloidally dispersed negative particles in the smoke to be coalesced into clumps of increased size and mass, marked improvement in filter efficiency is attained.

In the preferred embodiment of the invention, the coalescing agent is selected from the group consisting of colloidal alumina, alumina-coated colloidal silica and mixtures thereof. The particles of colloidal alumina and silica are crystalline and possess a positive charge or a positive zeta potential at the pH of tobacco smoke which is approximately in the range of 3–6. The crystalline and positively charged alumina or alumina-coated silica particles function to adsorb on their surfaces the negatively charged particles in the tobacco smoke, and their hydrophobic and oleophilic character serve to maintain the effectiveness of the filter despite the presence of moisture and of tars.

In order to substantially increase the effectiveness of the filter, the tobacco with which the filter is associated preferably is treated so that in the burning the resulting smoke will contain more particulates which are negatively charged, also more strongly negatively charged, in addition to the particulates which normally are negatively charged. For this purpose, the tobacco has deposited thereon particles of a water-insoluble, hydrophobic, moisture-laden, negative charge-imparting substance.

Tobacco treated with a water-insoluble, hydrophobic, moisture-laden substance and processed into cigarette with or without a filter of the usual type such as cellulose acetate tow furnishes a number of advantages though the filtration essentially is not improved to any appreciable extent.

DESCRIPTION OF THE PREFERRED EMBODIMENTS

To increase the size of the particles suspended in the smoke or vapor phase, or to act as a coalescing agent, a substance is used which possesses a positive charge on its surface for action upon the fine colloidal negatively charged particles in the smoke stream. Materials which have been found to be particularly suitable as coalescing agents are crystalline colloidal alumina and alumina-coated colloidal silica having a positive charge at the pH of tobacco smoke. Tobacco smoke has a pH of approximately 3-6. The positive charge or the positive zeta potential on the coalescing agent attracts the negative charge on the suspended particles, neutralizing them and causing coalescence into clumps of larger size and reducing the number of particle units.

The coalescing agent is used to impregnate the filter material, for example, cellulose acetate tow as commonly used in cigarette filters. The dry powder alumina or alumina-coated silica or mixture thereof is held mechanically by the matted cellulose acetate fibers. In lieu of cellulose acetate tow, any suitable porous substrate may be used, for example, fibers of cotton, silk, nylon, or mixtures thereof, or a cellular plastic such as polyurethane or the like.

If desired, a surface-active cationic or nonionic wetting agent ma be added to further enhance the ability of the positively charged material to take on moisture which comes in contact with it to produce a synergistic effect. An example of a cationic wetting agent is n-alkyl dimethyl benzyl ammonium chloride (Hydramine 3500-Rohm and Haas), and a suitable nonionic agent is alkylated aryl polyether alcohol (Triton X-100-Rohm and Haas).

Also, the addition of a moisture-retaining or hygroscopic substance such as glycerine or sorbitol will aid the positively charged particles constituting the coalescing agent to take on and hold moisture.

The lowering of the pH of the filter accelerates the process of coalescence and adsorption. It is preferred to use a latent acid compound such as gluco delta lactone which, by hydrolysis, generates lactic acid. Other materials such as hydro ammonium phosphate may also be used.

An additional hydrophilic adsorber for the alkaloids, such as nicotine, is magnesium trisilicate. This can be added to the mixture containing the coalescing agent.

The following examples illustrate several preferred embodiments of the invention:

EXAMPLE 1

| | Parts by Weight | Percent |
|---|---|---|
| Coalescing Agent (solids) | 25.0 | 50.0 |
| Water | 25.0 | 50.0 |

In the above Example, the coalescing agent is a mixture of two (2) compositions, one made by DuPont under its designation "Positive Sol 130M", and the other is "Dispal Alumina", made by Continental Oil Co. Five (5) parts of the former and ten (10) parts of the latter were used. Positive Sol 130m is an acidic aqueous dispersion of positively charged colloidal particles consisting of a dense silica core coated with positively charged polymeric alumina. The mole ratio of aluminum to surface silica is 1:1. The particles are colloidal silica with a polymeric coating of positively charged Al-O-Al species. The approximate chemical composition is as follows:

| | Percent |
|---|---|
| $SiO_2$ | 26.0 |
| $Al_2O_3$ | 4.0 |
| Cl | 1.4 |
| MgO | 0.2. |

Dispal Alumina has a chemical composition as follows:

| | Percent |
|---|---|
| Alpha alumina monohydrate | 90.0 |
| Water | 9.0 |
| Carbon (as primary alcohol) | 0.5 |
| $SiO_2$ | 0.008 |
| $Fe_2O_3$ | 0.005 |
| $Na_2O$ | 0.004 |
| S | 0.005. |

Cellulose tow was impregnated with the aqueous colloidal dispersion of the alumina and silica mixture, following which the water was driven off by drying, thereby depositing the solid colloidal particles upon the fibrous material. The coated or impregnated tow was then shaped into filters for incorporation into cigarettes.

EXAMPLE 2

| | Parts by Weight | Percent |
|---|---|---|
| Coalescing Agent (solids) | 5.0 | 37.5 |
| Water | 25.0 | 62.5 |

In the above Example, Positive Sol 130M, as described above, was used. As above described in connection with Example 1, the tow was impregnated with the aqueous dispersion of the colloidal silica. The two was impregnated as above described and filters made thereof.

EXAMPLE 3

| | Parts by Weight | Percent |
|---|---|---|
| Coalescing Agent (solids) | 20.0 | 20.0 |
| Hydrophilic Absorbing Agent | 5.0 | 5.0 |
| Water | 75.0 | 75.0 |

In the foregoing Example, the coalescing agent comprises a mixture of five (5) parts of Positive Sol 130M having the composition as above described, and ten (10) parts of colloidal alumina as made by Cabot Corporation of Boston, Mass. under its designation "Alon". The hydrophilic agent is a magnesium trisilicate. As previously described, the ingredients were thoroughly mixed. The fibrous material was impregnated, followed by drying and the shaping into filters for incorporation into cigarettes.

The described colloidal alumina and silica are made by a dry or flame process to provide fumed alumina and silica particles which are crystalline and have a strong positive surface charge that remains positive even in water and forms a strong bond with negatively charged particles. The particles have a positive zeta potential at the pH of tobacco smoke, approximately 3–6. Also, the particles are water-insoluble, hydrophobic and oleophilic.

Although the invention is preferably used as the filter end of a cigarette, a cartridge may be made in accordance with the invention for mounting in a cigarette holder as known in the art.

Although negatively charged particles predominate, tobacco smoke also contains particles which are positively charged and particles which are neutral. The invention contemplates the treatment of the tobacco so that the carcinogenic tars are removed to an even greater extent by treating the tobacco to be associated with the described filter so that upon burning of the tobacco stronger and additional negative charges are imparted to or induced upon the particulate matter or particles in the smoke. Also, a number of advantages of the invention are realized by the treatment of the tobacco, as will hereinafter be described, without necessitating the association of the tobacco so treated with the described filter.

For the foregoing purposes, the divided tobacco for use in a cigarette or the like has mixed therewith particles of a water-insoluble, hydrophobic, moisture-laden, negative charge-inducing or -imparting substance. Materials of this kind presently known may be generally designated as methylated silicas, and are marketed by Cabot Corporation, Boston, Mass. 02110 under the trademark "Silanox", and by Degussa, Inc., Kearny, N.J. 07032 under the trademark "Aerosil". The product made by Cabot Corporation is a trimethylsilyl group of the surface of the base-fumed silicon dioxide particle after reaction with silane. The reaction changes the surface characteristic of the silicon dioxide from hydrophilic to hydrophobic. The formula is $(CH_3)_3$—Si—O—Si. The product made by Degussa is essentially the same except that there are two (2) methyl groups instead of three (3).

In the presence of the hydrophobic, colloidal, negatively charged methylated silica, water is finely dispersed, so that the fine mist-like particles are surrounded by the colloidal silica particles to prevent them from reuniting to form larger particles. A substance is obtained which has the appearance of a dry powder. Such dry powder is best obtained by using approximately 10% of the colloidal silica and 90% water. Objects immersed in this material are not wetted, and this emulsion of water in hydrophobic, colloidal, methylated silica may be described as "dry water".

Divided tobacco to be made into a cigarette is mixed with the described negatively charged hydrophobic, methylated silica-water system, or "dry water", so that the composition is uniformly dispersed throughout the tobacco. Tobacco thus treated when made into a rod confined by cigarette paper and assembled with a filter made as hereinbefore described furnishes substantially better results than the described filter associated with tobacco which has not been so treated.

Tobacco subjected to the "dry water" treatment incorporated into a cigarette with or without a filter of the usual type such as cellulose acetate tow type reduced harshness, furnishes a cooler smoke, and furnishes many of the advantages which are generally associated with smoking tobacco through a hookah-type of device. It is not essential that the methylated silica be negatively charged when so used.

The described filter, and cigarette made with the filter associated with tobacco treated as hereinbefore described act to remove a substantial amount of carcinogenic tars and nicotine; nevertheless, the flavor of the cigarette is not lost because it appears that the flavor-supplying ketones, carbonyls and esters are retained.

All of the compositions, materials and substances referred to are non-toxic and do not present a health hazard to the smoker.

It is believed that the advantages and improved results afforded by the filter of the invention, by tobacco treated in accordance with the invention, and by a cigarette comprising tobacco treated in accordance with the invention associated with the described filter will be apparent from the foregoing description of the preferred embodiments of the invention. Various changes and modifications may be made without departing from the spirit and scope of the invention as sought to be defined in the following claims.

I claim:

1. A filter for tobacco smoke comprising a porous substrate having a deposit thereon of particles which are crystalline, water-insoluble, hydrophobic, and oleophilic, and which have a sufficient positive charge at the approximately 3 to 6 pH range of tobacco smoke to attract and coalesce negatively charged particles dispersed in the tobacco smoke.

2. A filter according to claim 1, wherein the deposit includes an accelerating agent to accelerate the action of said particles.

3. A filter according to claim 2, wherein the accelerating agent is selected from the group consisting of gluco delta lactone and hydro ammonium phosphate.

4. A filter according to claim 1, wherein the deposit includes a surface-active wetting agent.

5. A filter according to claim 4, wherein the surface-active wetting agent is selected from the group consisting of n-alkyl dimethyl benzyl ammonium chloride and alkylated aryl polyether alcohol.

6. A filter according to claim 1, wherein the deposit includes a moisture-retaining agent.

7. A filter according to claim 6, wherein the moisture-retaining agent is selected from the group consisting of glycerine and sorbitol.

8. A filter according to claim 1, wherein the particles are selected from the group consisting of colloidal alumina, alumina-coated colloidal silica and mixtures of colloidal alumina and alumina-coated colloidal silica.

9. A filter according to claim 8, wherein the deposit includes an accelerating agent to accelerate the action of said particles.

10. A filter according to claim 9, wherein the accelerating agent is selected from the group consisting of gluco delta lactone and hydro ammonium phosphate.

11. A filter according to claim 8, wherein the deposit includes a surface-active wetting agent.

12. A filter according to claim 11, wherein the surface-active wetting agent is selected from the group consisting of n-alkyl dimethyl benzyl ammonium chloride and alkylated aryl polyether alcohol.

13. A filter according to claim 8, wherein the deposit includes a moisture-retaining agent.

14. A filter according to claim 13, wherein the moisture-retaining agent is selected from the group consisting of glycerine and sorbitol.

* * * * *